US005347957A

United States Patent [19]

Sugahara

[11] Patent Number: 5,347,957

[45] Date of Patent: Sep. 20, 1994

[54] WATER HEATER WITH REDUCED $NO_x$ OUTPUT

[75] Inventor: Tatsuya Sugahara, Tokyo, Japan

[73] Assignee: Tokyo Gas Company Ltd., Tokyo, Japan

[21] Appl. No.: 919,098

[22] Filed: Jul. 23, 1992

[30] Foreign Application Priority Data

Jul. 26, 1991 [JP] Japan ..... 3-209943
Oct. 24, 1991 [JP] Japan ..... 3-305496

[51] Int. Cl.[5] ..... F22B 5/02

[52] U.S. Cl. ..... 122/18; 122/14; 122/235.15; 122/264; 126/361

[58] Field of Search ..... 122/18, 264, 235.15, 122/14; 126/361, 350 R

[56] References Cited

U.S. PATENT DOCUMENTS 4,421,066 12/1983 Gordbegli ..... 122/264
4,499,859 2/1985 Nishiguchi et al. ..... 122/18

*Primary Examiner*—Edward G. Favors
*Attorney, Agent, or Firm*—Vineet Kohli; Thomas P. Morrison

[57] ABSTRACT

A water heater with reduced nitrogen oxides output utilizing $NO_x$ reducing water conduits to cool a laminar flame and thereby reduce production of nitrogen oxides, The water heater has a partially aerated burner using a partially premixed combustion method to produce the laminar flame wherein a plurality of $NO_x$ reducing water conduits are disposed above the partially aerated burner in such a manner that water is supplied from a cold water conduit or a hot water conduit of the water heater into the plurality of $NO_x$ reducing water conduits through a water introducing portion by means of branching or serial connections. The water absorbs heat while flowing through the plurality of $NO_x$ reducing water conduits and is returned to the cold water conduit or the hot water conduit through a water receiving portion by means of and branching or serial connections.

15 Claims, 20 Drawing Sheets

WATER HEATER WITH REDUCED $NO_x$ OUTPUT

BACKGROUND OF THE INVENTION

The present invention relates to a water heater with reduced nitrogen oxides output.

Most water heaters adopt a so-called Bunsen combustion system which carries out partially premixed combustion at the primary air ratio of 0.1–0.7 which is followed by combustion with secondary air. In cases where this method is used, the amount of generated nitrogen oxides (hereinafter called $NO_x$) is approximately 100–150 ppm when corrected to 0% of $O_2$ (the same correction is hereinafter applied). In such a case, known examples for reducing $NO_x$ generated include a fully premixed combustion system, a flame cooling system using a radiation rod and an exhaust gas recycling system.

Although the fully premixed combustion system is capable of reducing $NO_x$ to less than 60 ppm by increasing an excess air ratio and consequently lowering the temperature of the flame, a problem exists in that it is necessary to precisely control the excess air ratio and prevent oscillating combustion and backfiring, which tends to occur in the method. This causes the manufacturers to incur a large cost increase due to their efforts to implement countermeasures.

The flame cooling method using a radiation rod calls for inserting a radiation rod in the flame so that the rod is heated until it glows red and emits radiation heat, thereby reducing the temperature of flame and, thus, the generation of $NO_x$. Output of carbon monoxide (hereinafter called CO) is prevented by heating of the radiation rod. For this reason, however, it is necessary to use ceramics or heat resistant steel for the radiation rod In addition to the fact that such materials are costly and their durability is insufficient, there is a limit to which the radiation is able to lower the temperature and reduce $NO_x$ with this method. And, it is very difficult to reduce $NO_x$ by more than about 30% without CO emission.

As for the exhaust gas recycling method, it is widely known that the amount of $NO_x$ emission can be reduced to a half when the recycling ratio of exhaust gas is 10–15%. For the capacity of Bunsen burners of conventional water heaters, however, it is impossible to recycle exhaust gas at such a high recycling ratio as 10–15%; this may otherwise result in a lifted flame. Therefore, under the present conditions, such conventional water heaters are able to reduce $NO_x$ only to approximately 90 ppm by this method. Furthermore, it is necessary to take measures to prevent exhaust gas from causing corrosion in conduits used for recycling exhaust gas, fans and burner units; such extra efforts result in cost increases. Because of the above reasons, there is strong demand for development of a water heater which is capable of greatly reducing $NO_x$ and restricting an output of CO while maintaining a relatively simple construction and avoiding cost increases to the greatest extent possible.

SUMMARY OF THE INVENTION

In order to solve the foregoing problems, the present waiter heater with reduced nitrogen oxides output, having a partially aerated burner producing laminar flame using partially premixed combustion above a plurality of serially aligned flame ports, wherein a plurality of $NO_x$ reducing water conduits are disposed above the partially aerated burner in such a manner that water is supplied from a cold water conduit or a hot water conduit of the water heater into the plurality of $NO_x$ reducing water conduits through a water introducing portion by means of branching or serial connections and the water, heated by the absorption of heat while flowing through the plurality of $NO_x$ reducing water conduits, is returned to the cold water conduit or the hot water conduit through a water receiving portion.

As shown in the embodiment explained hereinafter, the structure of the water introducing portion and the water receiving portion connected to the $NO_x$ reducing water conduit may be modified and selected as necessary.

According to the present invention, a plurality of $NO_x$ reducing water conduits are disposed in an appropriate positional range, which is formulated as follows below, the range being located between the range where the temperature of laminar flame formed at the downstream side of the burner port is the highest and the burner port in order to remove heat from the laminar flame by heat absorption of the plurality of $NO_x$ reducing water conduits and lowering the temperature of flames in the highest flame temperature range at the downstream side of the $NO_x$ reducing water conduit, thereby reducing an output of $NO_x$ $$0<H\leqq 5W$$

Where:

H=a distance between the $NO_x$ reducing water conduit and the surface of the burner port; and W=a width of the burner port surface (including a pilot member, if there is any).

According to the structure of the present invention, a diameter of each $NO_x$ reducing water conduit is set within the range formulated as follows in order to reduce output of nitrogen oxides while restricting output of carbon monoxide.

$$d\leqq W$$

Where:

d=the diameter of $NO_x$ reducing water conduit.

According to the present invention, a single $NO_x$ reducing water conduit is provided for each partially aerated burner, the $NO_x$ reducing water conduit being superposed right above the burner port surface.

According to the present invention, a pair of $NO_x$ reducing water conduits is provided for each partially aerated burner, a pair of water conduits being superposed right above the burner port surface in the manner that the two conduits are laterally parallel to each other with a space formulated as follows in between.

$$0<S<W$$

Where:

S=distance of the space between a pair of $NO_x$ reducing water conduits.

According to the present invention, the water heater comprises: a burner, a cold water conduit having a cold water inlet, a hot water conduit having a hot water outlet, a water distributing portion disposed at one side above the burner and communicated with a water flow passage from the cold water inlet to the hot water outlet, the water distributing portion being communicated with a water introducing portion, a water collecting portion disposed at the other side above the burner and communicated with a water receiving portion, a plurality of $NO_x$ reducing water conduits connected to both of the water distributing portion and the water collecting portion and disposed above the burner, and an outer and inner diameter of each of the plurality of $NO_x$ reducing water conduits being smaller than those of the cold water conduit and the hot water conduit.

According to the present invention, a feeding direction in the water collecting portion is contrary to an introducing direction in the water distributing portion.

According to the present invention a feeding direction in the water collecting portion is the same as an introducing direction in the water distributing portion.

According to the present invention, by means of $NO_x$ reducing conduits disposed in an appropriate positional range between burner ports and the highest flame temperature range of laminar flame formed in the downstream side of burner ports, combustion heat is effectively absorbed and the temperature of flames in the highest flame temperature area at the downstream side thereof. Therefore, output of $NO_x$ is reduced and at the same time output of CO is restricted.

As a $NO_x$ reducing water conduit is so connected as to branch from and converge into a water conduit or a hot water conduit through a water receiving portion, absorbed heat is effectively utilized.

DETAILED DESCRIPTION OF THE INVENTION

Figure 1:
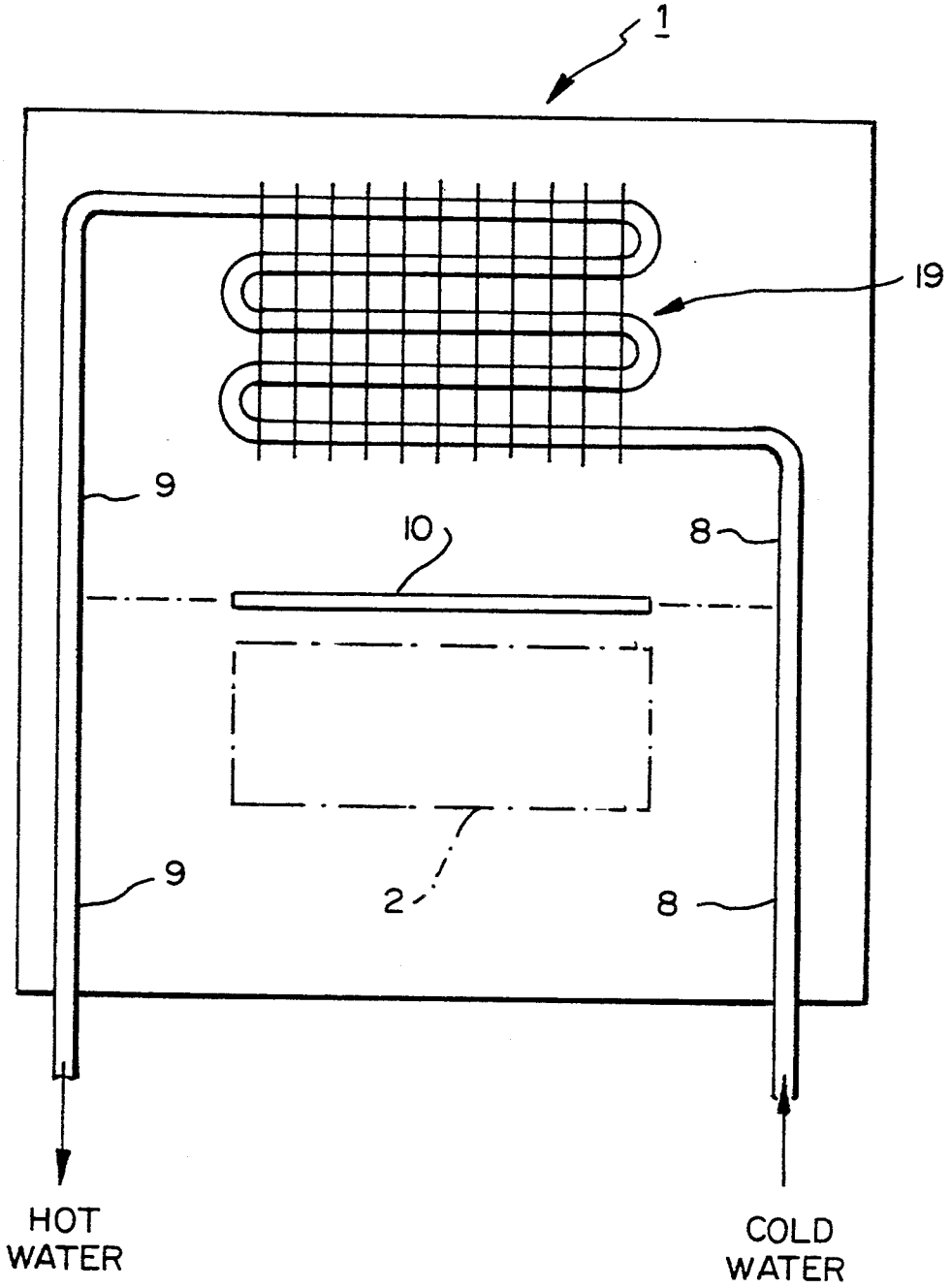
FIG. 1 is a schematic view showing an embodiment of a water heater according to the present invention.
Figure 2:
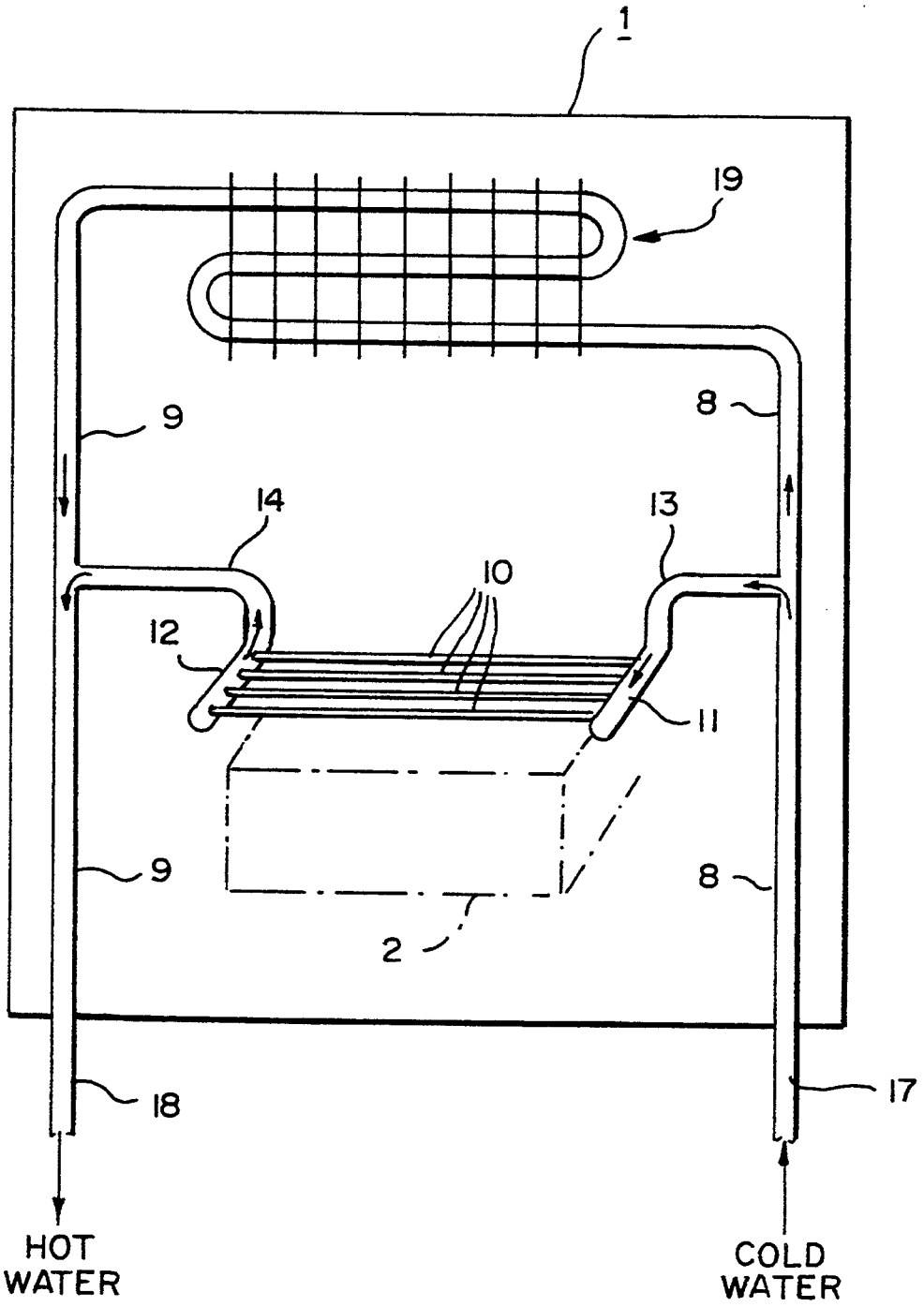
FIG. 2 is a schematic view of another embodiment of a water heater.
Figure 3:
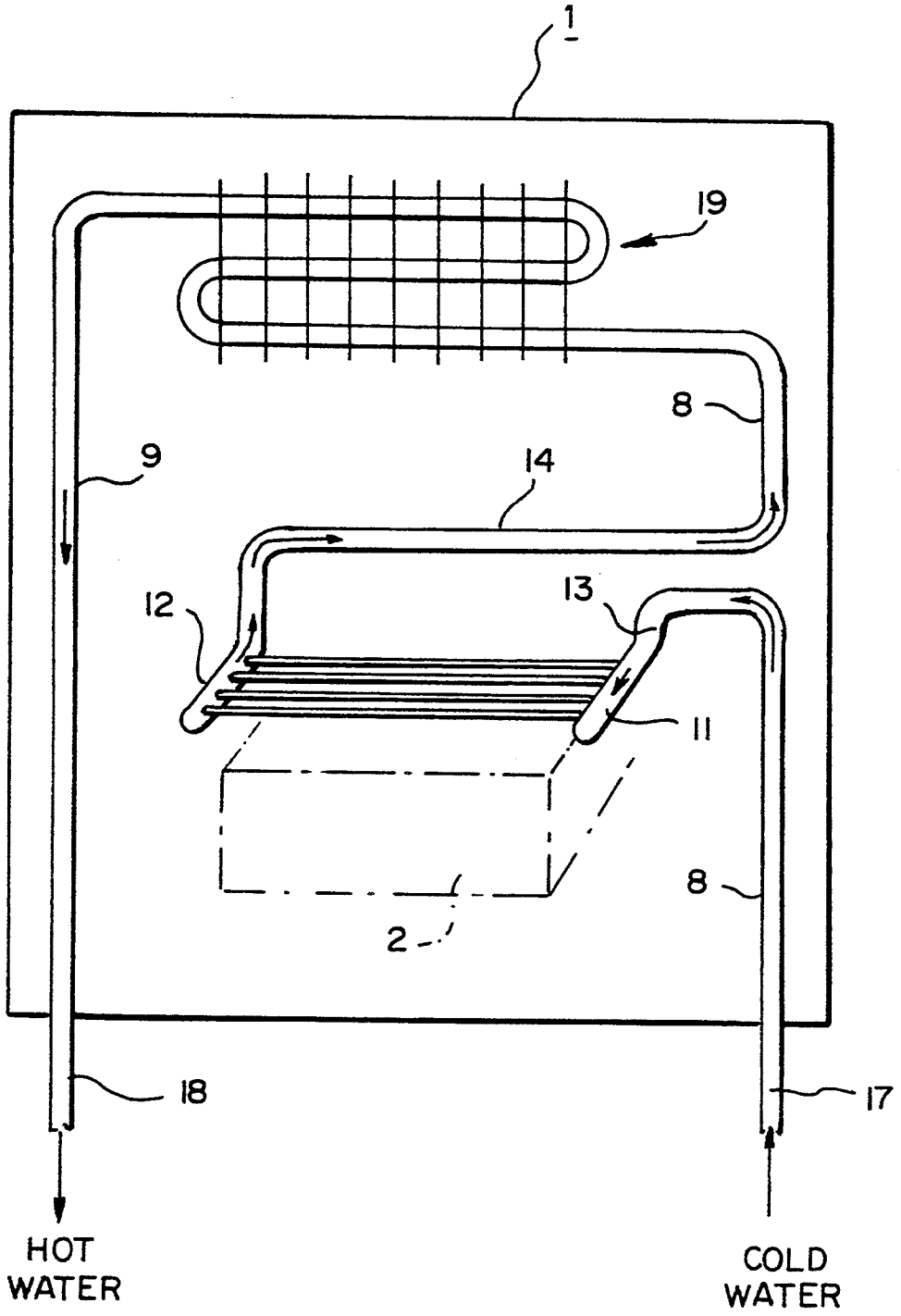
FIG. 3 is a schematic view of another embodiment of a water heater.

In the drawings, numerals 1, 8 and 9 respectively denote a water heater, a cold water conduit and a hot water conduit. Numeral 2 denotes a burner. As described above there are two kinds of burner 2; one with a pilot member 4 and another without pilot member 4. Numeral 10 denotes a plurality of $NO_x$ reducing water conduits in between water introducing portion 13 and water receiving portion 14 (see FIG. 2) and has such a configuration that heated water is returned to cold water conduit 8 or hot water conduit 9 after the process of heat absorption. There are various configurations for water introducing portion 13 and water receiving portion 14, one such configuration is shown in FIG. 2 introducing a part of a water flow in cold water conduit 8 into $NO_x$ reducing water conduits 10 and then feeding the water out towards hot water conduit 9; another shown in Fig. 3 which calls for introducing the entire water flow in cold water conduit 8 into $NO_x$ reducing water conduits 10 and then returning the heated water into cold water conduit 8; another shown in FIG. 4 introduces a part of the water flow in cold water conduit 8 into $NO_x$ reducing water conduits 10 and then returns the heated water into cold water conduit 8; another shown in FIG. 5 introduces the entire hot water flow in hot water conduit 9 into $NO_x$ reducing water conduits 10 and then returns the further heated hot water into hot water conduit 9; and another shown in FIG. 6 introduces a part of the hot water flow in hot water conduit 9 into $NO_x$ reducing water conduits 10 and then returns the further heated hot water into hot water conduit 9. The drawings show examples of configurations only for the purpose of explanation, and a user may select a desired configuration as necessary.

$NO_x$ reducing water conduits 10 comprised together with water introducing portion 13 and water receiving portion 14 configured as above, are superposed in parallel with each other above the surface of burner ports 3. $NO_x$ reducing water conduits 10 must be disposed within an appropriate positional range wherein $0<H<5W$.

In addition to reducing output of $NO_x$ it is also possible to restrict output of CO by setting the diameter of $NO_x$ reducing water conduits 10 such that $d<W$, when the $NO_x$ reducing water conduits 10 are disposed in the appropriate positional range. In the above formulas, "H", "W" and "d" respectively represent the distance between $NO_x$ reducing water conduits 10 and the surface of the burner ports, the width of the surface of a burner port (including the width of a pilot member if there is any), and the diameter of a $NO_x$ reducing water conduit.

$NO_x$ reducing water conduits 10 superposed right above burner ports 3 and parallel to the burner, may comprise a single conduit or a pair of conduits for each burner, with space S between the pair of conduits. In the latter case, S should be in the range of $0<S\leqq W$. As $NO_x$ reducing water conduits 10 are superposed parallel to each burner, heat is exchanged by $NO_x$ reducing water conduits 10 effective.

In the case shown in FIG. 2, when water is introduced into a water heater 1, a part of the water flows from cold water conduit 8 into $NO_x$ reducing water conduits 10, where it absorbs heat, and then, the heated water is fed to the outside of the water heater through hot water conduit 3. At that time, premixed air has already been introduced to burner 2, at the excess air ratio of 0.1–0.7, and flame 6 is generated at burner port 3. The heat of flame 6 is absorbed by water flowing through $NO_x$ reducing water conduits 10, and thus, the temperature generated in the highest flame temperature range 7 at the downstream side of $NO_x$ reducing water conduits 10 is effectively reduced. In this case, $NO_x$ reducing water conduits 10 are disposed in the appropriate positional range $0<H\leqq 5W$. In the event that H is less than 0, it causes such problems as flame-lift and insufficient heat absorption due to the fact that the combustion, at the position where the value of H is too small, does not produce sufficient heat. As a result, the temperature of flame at the downstream side of $NO_x$ reducing water conduits 10 is not sufficiently lowered, and $NO_x$ reduction effect is small. On the other hand, although it is possible to increase the amount of heat absorption by increasing the value of H so that it is greater than 5W, when a large value is used for "H", the temperature of combustion gas, before the flame reaches the $NO_x$ reducing water conduit, has already reached a temperature sufficient to increase the output of $NO_x$ at the upstream side. Therefore, with excessively high "H", it is impossible to reduce $NO_x$ by a large degree.

By means of restricting the diameter (d) of $NO_x$ reducing water conduits 10, disposed in the appropriate range shorter than the width (W) of the surface of the burner port, combustion at the downstream side of $NO_x$ reducing water conduits 10 continues smoothly, thereby restricting the output of CO as well as $NO_x$. Furthermore, combustion in this configuration is nearly as quiet as the case where of $NO_x$ reducing water conduits 10 are not disposed. In the case where a pair of $NO_x$ reducing water conduits 10 are superposed right above burner ports 3 of each burner 2 with space S between the pair, laminar flame is obtained in good condition, and heat absorption from the laminar flame by $NO_x$ reducing conduits 10 increases. Therefore, low temperature combustion is achieved more effectively.

According to the above embodiments, water used in $NO_x$ reducing water conduits 10 to reduce $NO_x$ is heated by means of heat absorption from the laminar flame and is returned to cold water conduit 8 or hot water conduit 9 to be fed to the outside of the water heater. Thus, thermal efficiency does not decrease at all.

Figure 11:
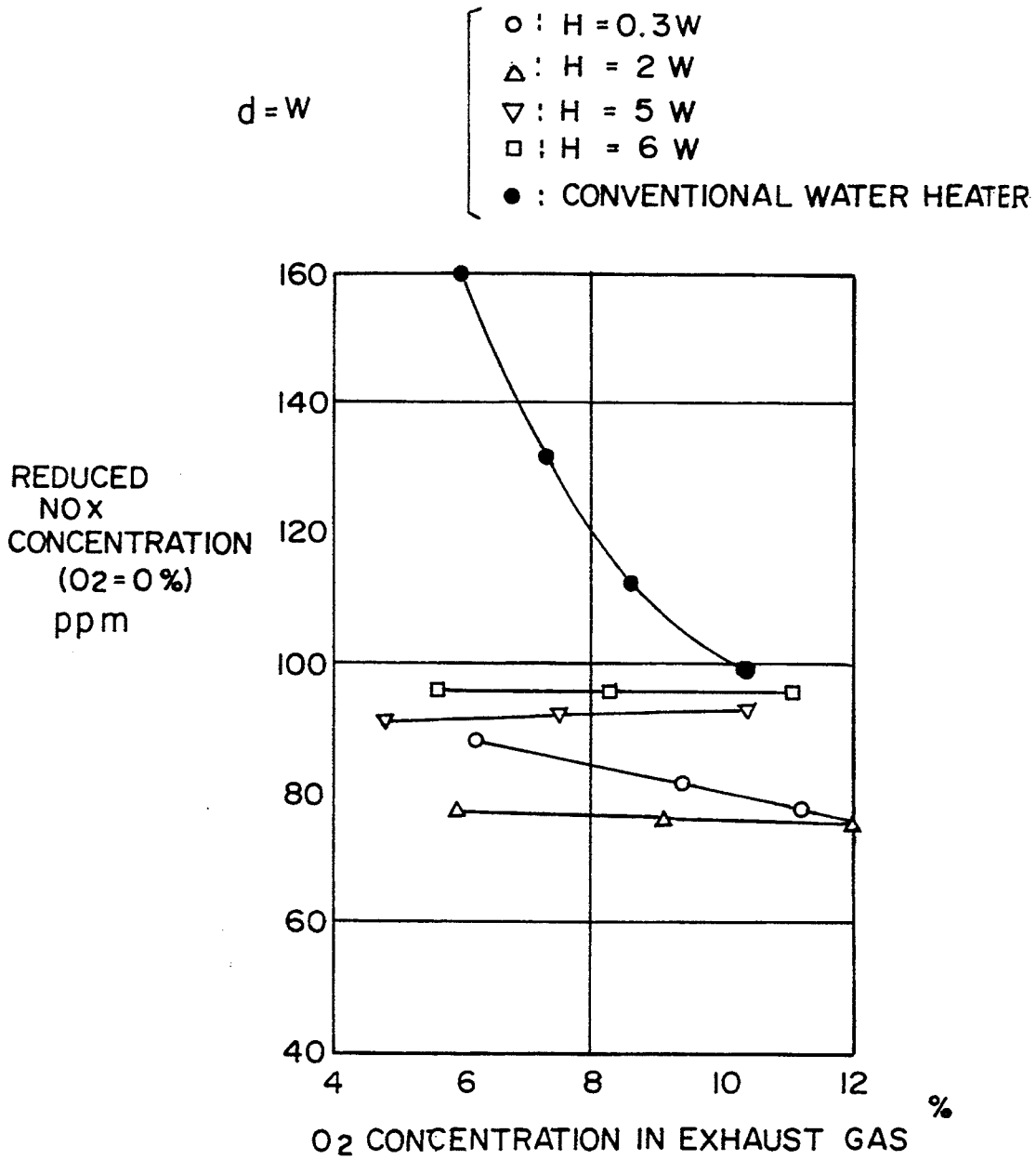
FIG. 11 is a plot of characteristics concerning emission of $NO_x$ in cases where a burner is provided with a pilot member and a single $NO_x$ reducing water conduit.

In FIGS. 1 through 20, numerals 5 and 19 respectively denote a pilot orifice and a heat exchanger. FIG. 11 shows an embodiment wherein each burner 2 having pilot member 4 is provided with a single $NO_x$ reducing water conduits 10. From FIG. 11, it is evident that, when H is within the range of $0.3W<H\leqq 6W$, output of $NO_x$ is considerably lower than that of a conventional water heater. In this case, as long as $d=W$, no problem should occur because output of CO is restricted as noted above. When d is greater that W, however, the problem of flame-lift occurs and the objective of the present invention is therefore not achieved.

Figure 12:
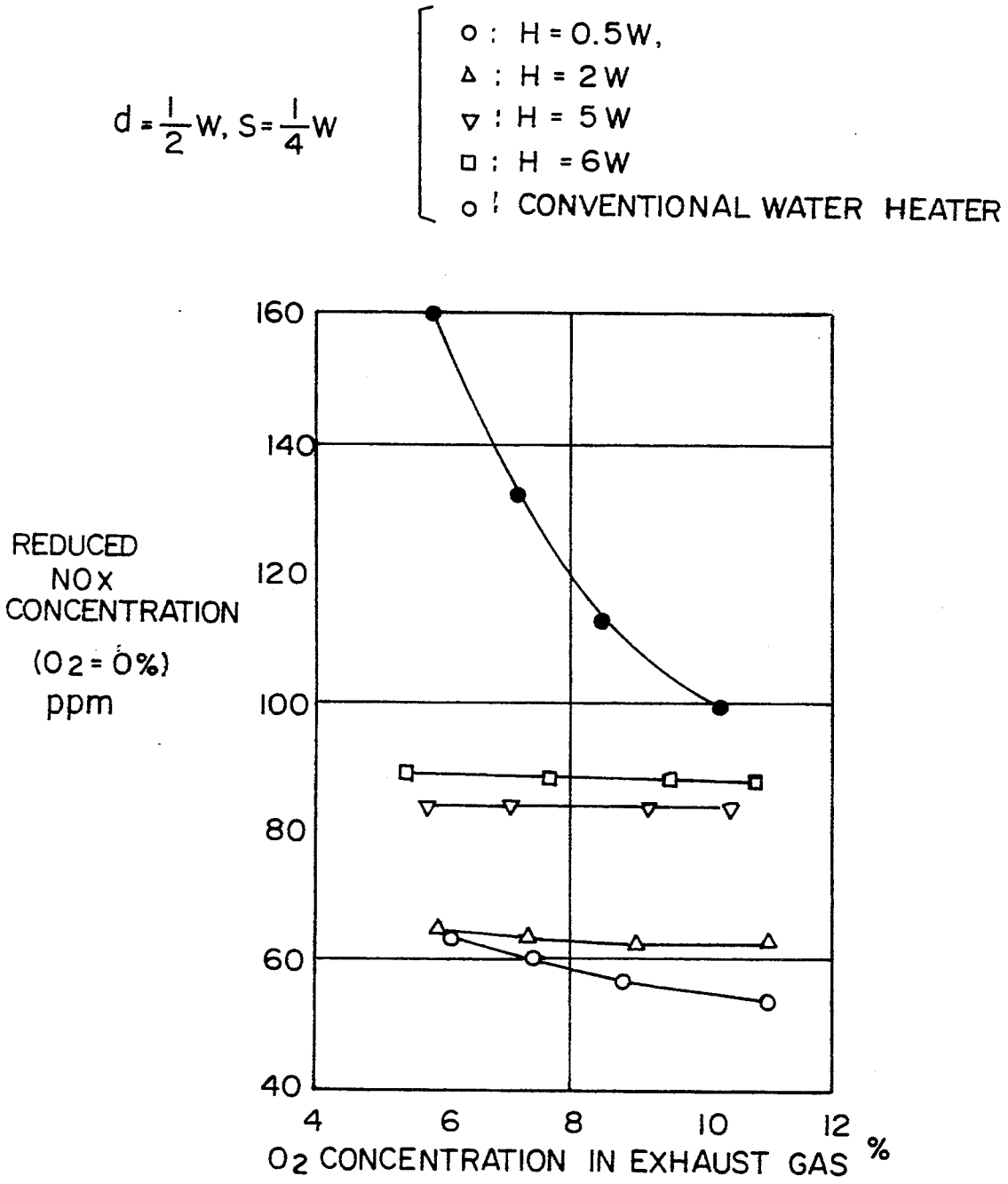
FIG. 12 is a plot of characteristics concerning emission of $NO_x$ in cases where a burner is provided with a pilot member and a pair of $NO_x$ reducing water conduits.
Figure 13:
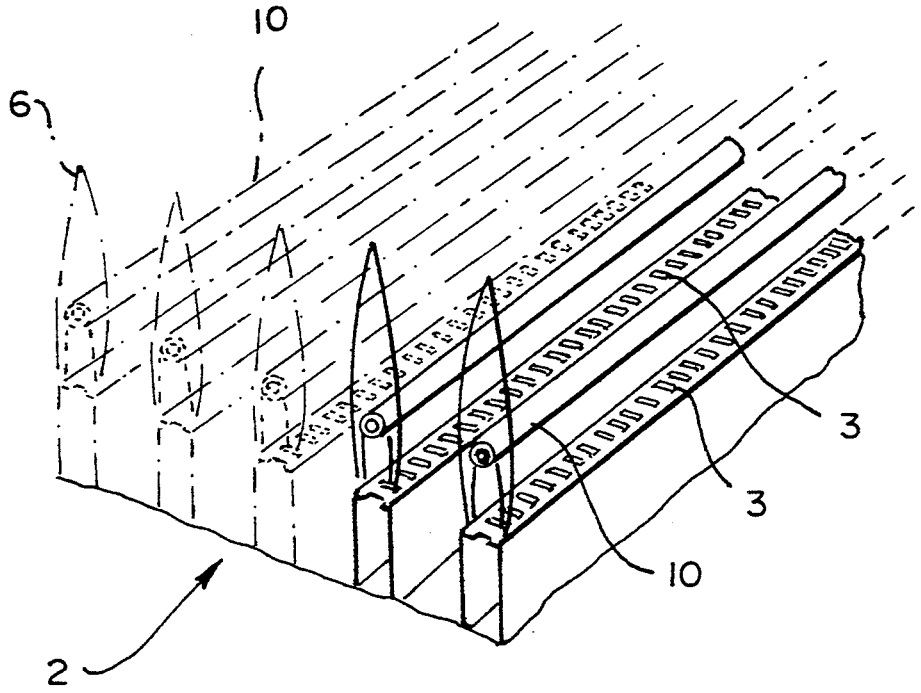
FIG. 13 is a perspective to illustrate the relationship of the position between a $NO_x$ reducing water conduit and a burner which is not provided with a pilot member.
Figure 14:
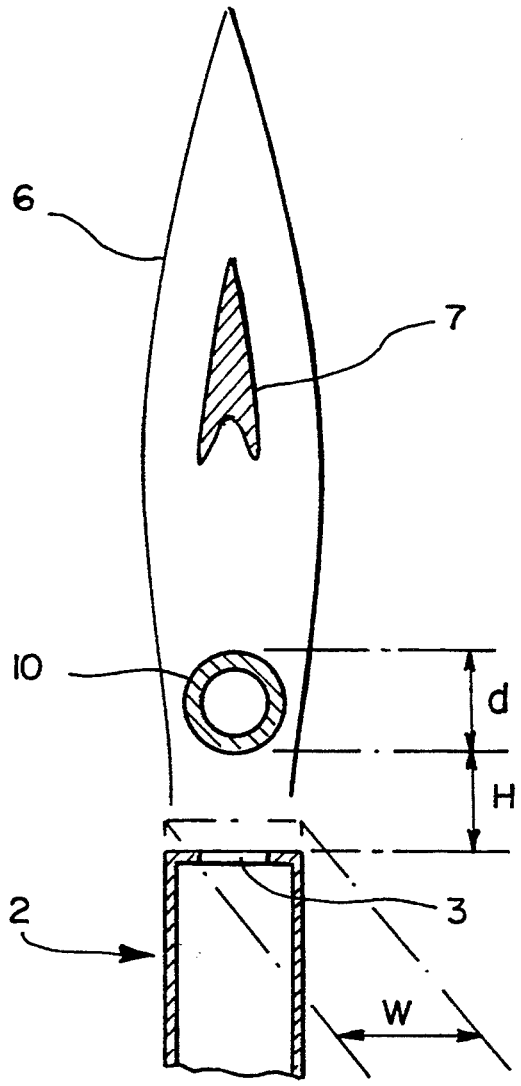
FIG. 14 is a section view of a principal part to illustrate the relationship of the position between $NO_x$ reducing water dented and a burner which is not provided with a pilot member.

In the same manner as above, FIG. 12 shows an embodiment wherein each burner 2 having pilot member 4 is provided with a pair of $NO_x$ reducing water conduits 10, which are laterally parallel and disposed with a space S there between. From FIG. 12, it is evident that when H is within the range of $0.5W<H\leqq 5W$, the output of $NO_x$ is considerably lower than that of a conventional water heater. Should H be equal to 0, however, the problem of flame-lift occurs. As long as $d=\frac{1}{2}W$, the output of CO is restricted as noted above. When d is greater than W, however, the problem of flame-lift occurs, and the object of the present invention is therefore not achieved.

Figure 15:
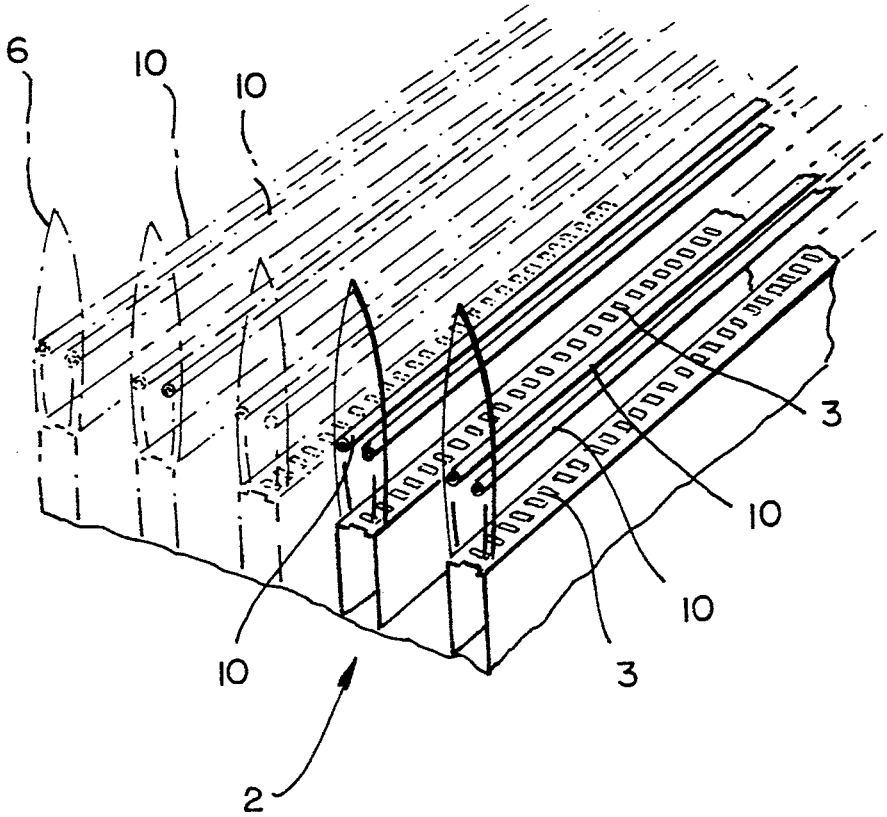
FIG. 15 is a perspective view of another embodiment to illustrate the relationship of the position between a $NO_x$ reducing water conduit and a burner which is not provided with a pilot member.
Figure 16:
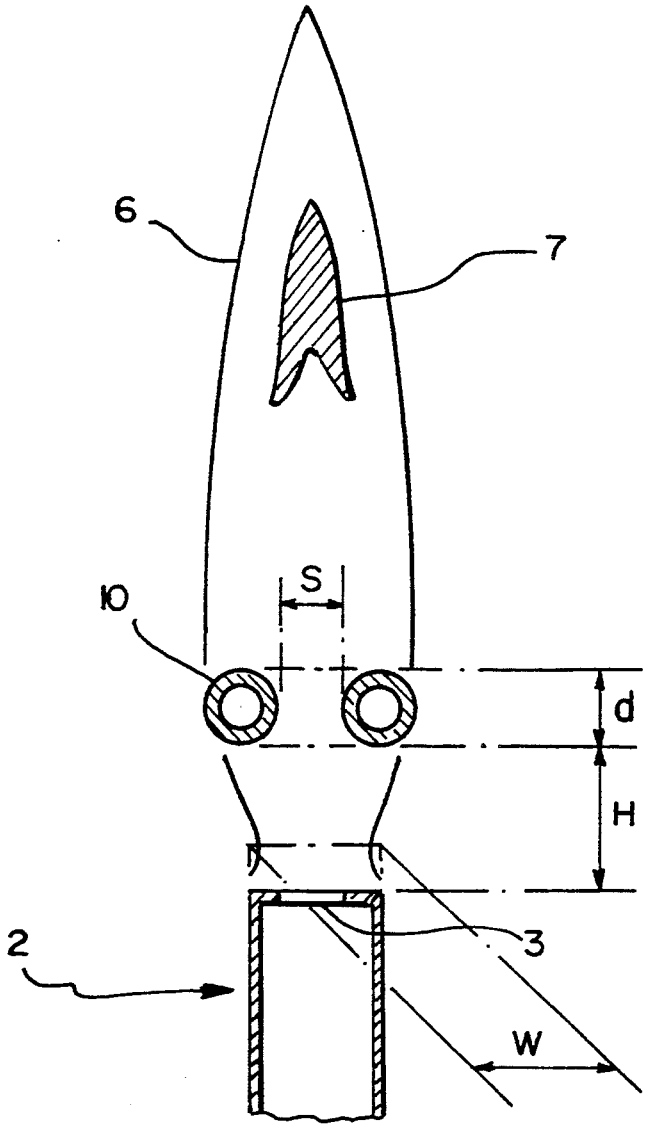
FIG. 16 is a section view of a principal part of another embodiment to illustrate the relationship of the position between a $NO_x$ reducing water conduit and a burner which is not provided with a pilot member.
Figure 17:
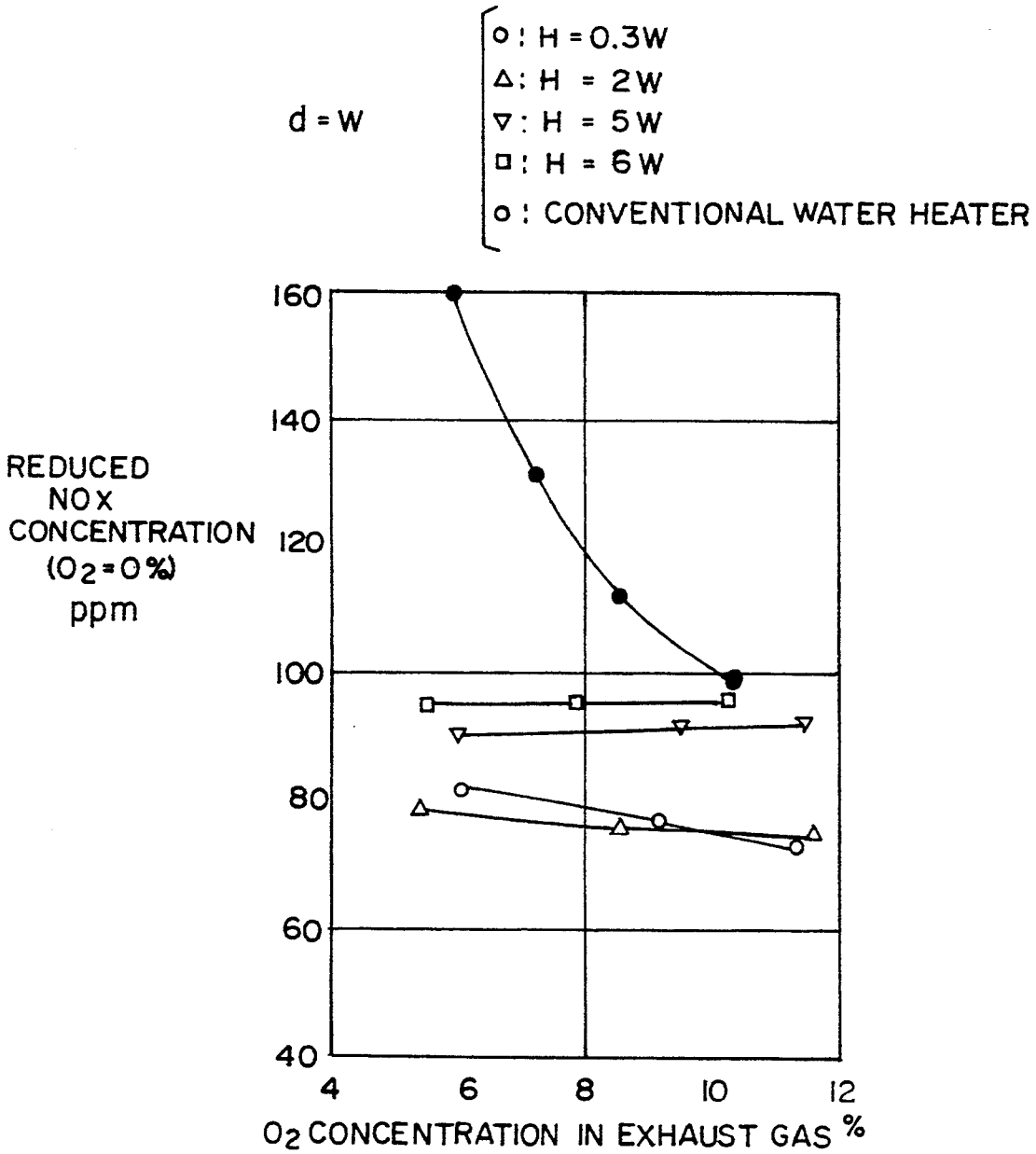
FIG. 17 is a plot of characteristics concerning discharge of $NO_x$ in cases where a burner is provided with a single $NO_x$ reducing water conduit and no pilot member.
Figure 18:
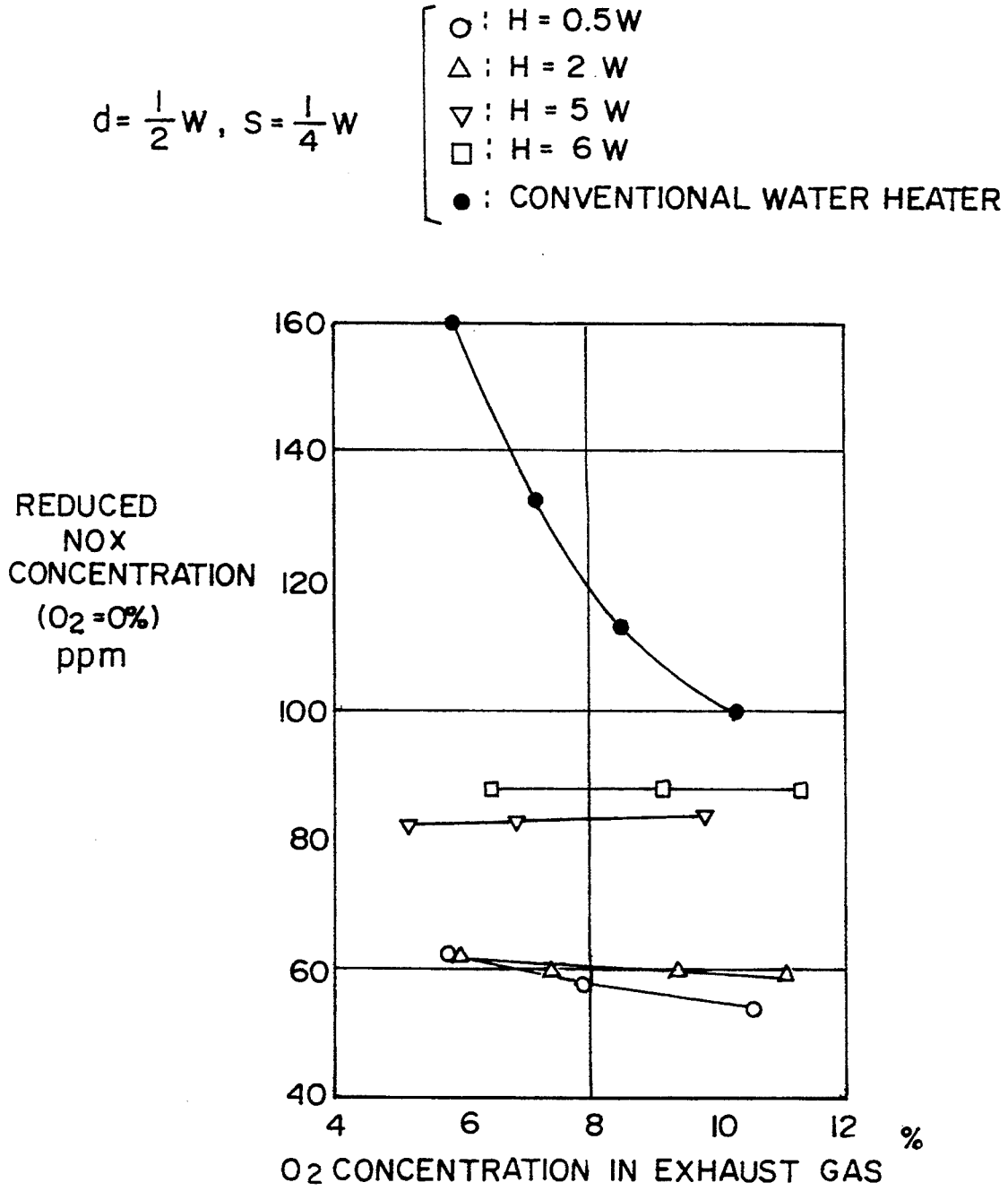
FIG. 18 is a plot of characteristics concerning discharge of $NO_x$ in cases where a burner is provided with a pair of $NO_x$ reducing water conduits and no pilot member.

FIG. 13 through 16 show embodiments wherein burner 2 does not have pilot member 4. In the embodiments shown in FIGS. 13 and 14, each burner 2 is provided with a single $NO_x$ reducing water conduit 10, whereas burner 2 of the embodiments shown in FIGS. 15 and 16 is provided with a pair of $NO_x$ reducing water conduits 10. From FIGS. 17 and 18, it is evident that, when H is within the range of $0.5W\leqq H\leqq 5W$, output of $NO_x$ is considerably lower than that of a conventional water heater. In this case, as long as $d=W$ (in case of a single $NO_x$ reducing conduit) or $d=W/2$ (in case of a pair of $NO_x$ reducing conduits), a CO problem should not occur because the output of CO is restricted as described above. When d is greater than W, however, the problem of flame-lift occurs, and the object of the present invention is therefore not achieved. As mentioned the above, to reduce $NO_x$ effectively, it is required to dispose the $NO_x$ reducing water conduit 10 at an appropriate position in flame 6.

In a heater 1 having a $NO_x$ reducing water conduit 10 having the same diameter of a cold water conduit 8 and of a hot water conduit 9, it is difficult to dispose a plurality of $NO_x$ reducing water conduits 10 in close and parallel to each other, thus, a problem exists in that it is not possible to dispose the $NO_x$ reducing water conduit 10 at an appropriate position in flame 6 of the water heater.

Furthermore, when the distance between adjacent $NO_x$ reducing water conduits 10 disposed in flame 6 is small, it is difficult to form a bend having a small radius. Further, when the flow rate in the $NO_x$ reducing water conduit 10 is greater when its diameter is larger, some part of the surface temperature of the $NO_x$ reducing water conduit 10 may become lower than the dew-point temperature of combustion gas. Then, due to condensation of the combustion gas, a dew occurs on the surface of the $NO_x$ reducing water conduit 10, thereby causing corrosion of the $NO_x$ reducing water conduits 10 and bad combustion characteristics. Further, when the cold water conduit 8 or the hot water conduit 9 is inserted into the combustion gas, the problem is that because of a larger diameter of the cold water conduit 8 or hot water conduit 9 a uniform flame line of the combustion gas is disturbed and then a combustion noise is intensified.

In order to solve the foregoing problems, at one side above burner 2 there is disposed a water distribution manifold 11, while above and on the other side there is disposed a water collection manifold 12. Both the water distribution manifold 11 and water collection manifold 12 are connected to a plurality of $NO_x$ reducing water conduits 10 supported therebetween. The outer and inner diameter of each $NO_x$ reducing water 10 is to be smaller than that of cold water conduit 8 and of hot water conduit 9.

(2old water conduit 3 comprises a cold water inlet 12, while hot water conduit 4 comprises a hot water outlet 13.

The cold or hot water introduced into water distribution manifold 11 from an arrow direction is fed to water collection manifold 12 while absorbing a combustion heat through the plurality of $NO_x$ reducing water conduits 10.

As described above, the outer and inner diameter of each $NO_x$ reducing water conduit 10 is smaller than that of cold water conduit 8 and of hot water conduit 9. In addition, since the heat of the combustion gas is absorbed by the plurality of $NO_x$ reducing water conduits 10 partitioned separately, the surface temperature of $NO_x$ reducing water conduits 10 can be maintained in a condition so as to substantially reduce condensation. of the combustion gas. Accordingly, various problems occurring from condensation can be avoided.

In addition, since a water introducing direction in water distribution manifold 11 is, as shown in FIGS. 2–6, 19 and 20, contrary to a water feeding direction in water collection manifold 12, the cold or hot water flows uniformly in all of $NO_x$ reducing water conduits 10. Under the foregoing circumstances, the present device not only prevents the condensation more effectively, but also prevents boiling from occurring in $NO_x$ reducing water conduits 10 when the flow rate is low. Yet, in the light of the device construction or configuration, the water introducing direction in water distribution manifold 11 may be the same as the water feeding direction in water collection manifold 12.

Figure 4:
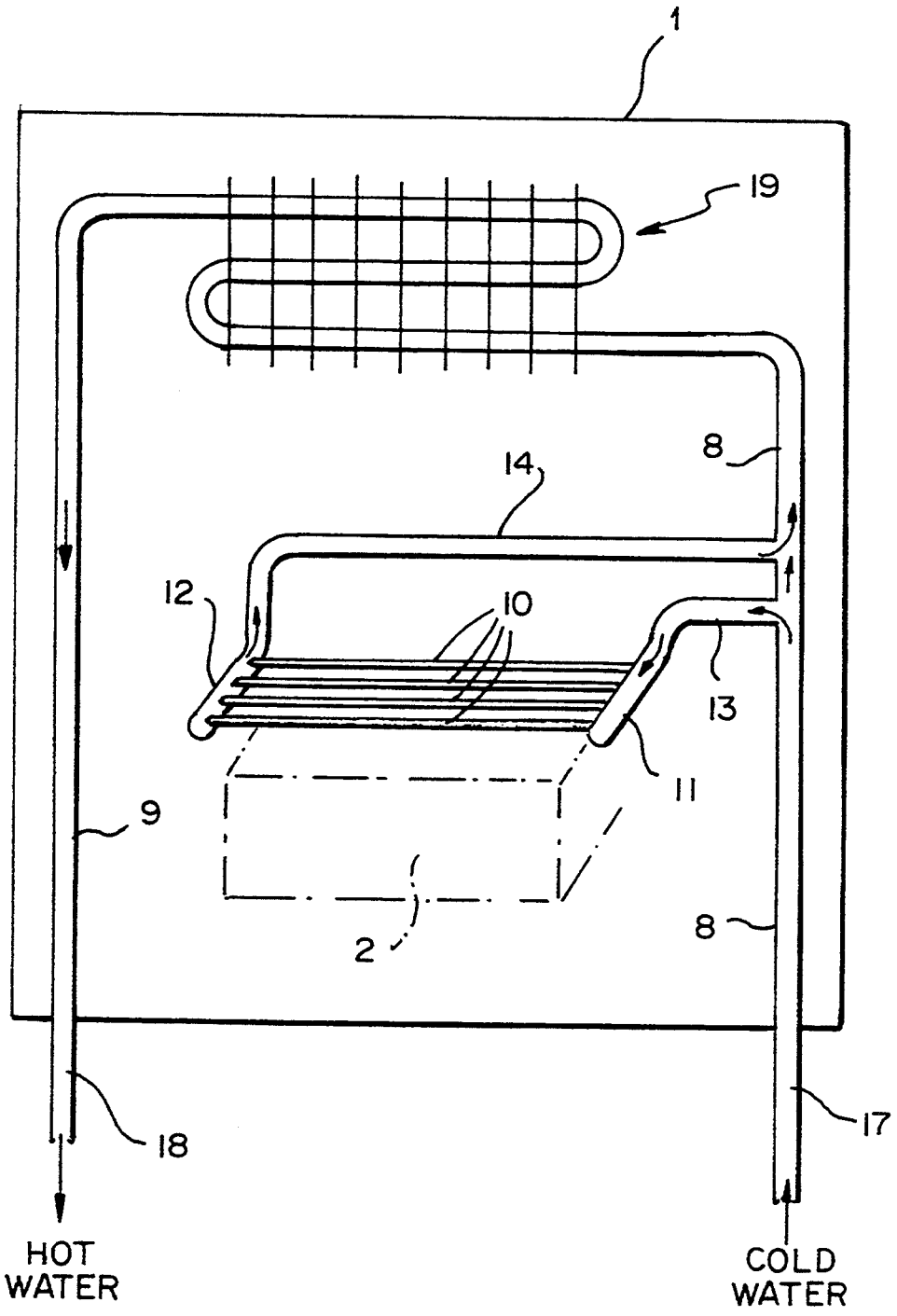
FIG. 4 is a schematic view of another embodiment of a water heater.
Figure 5:
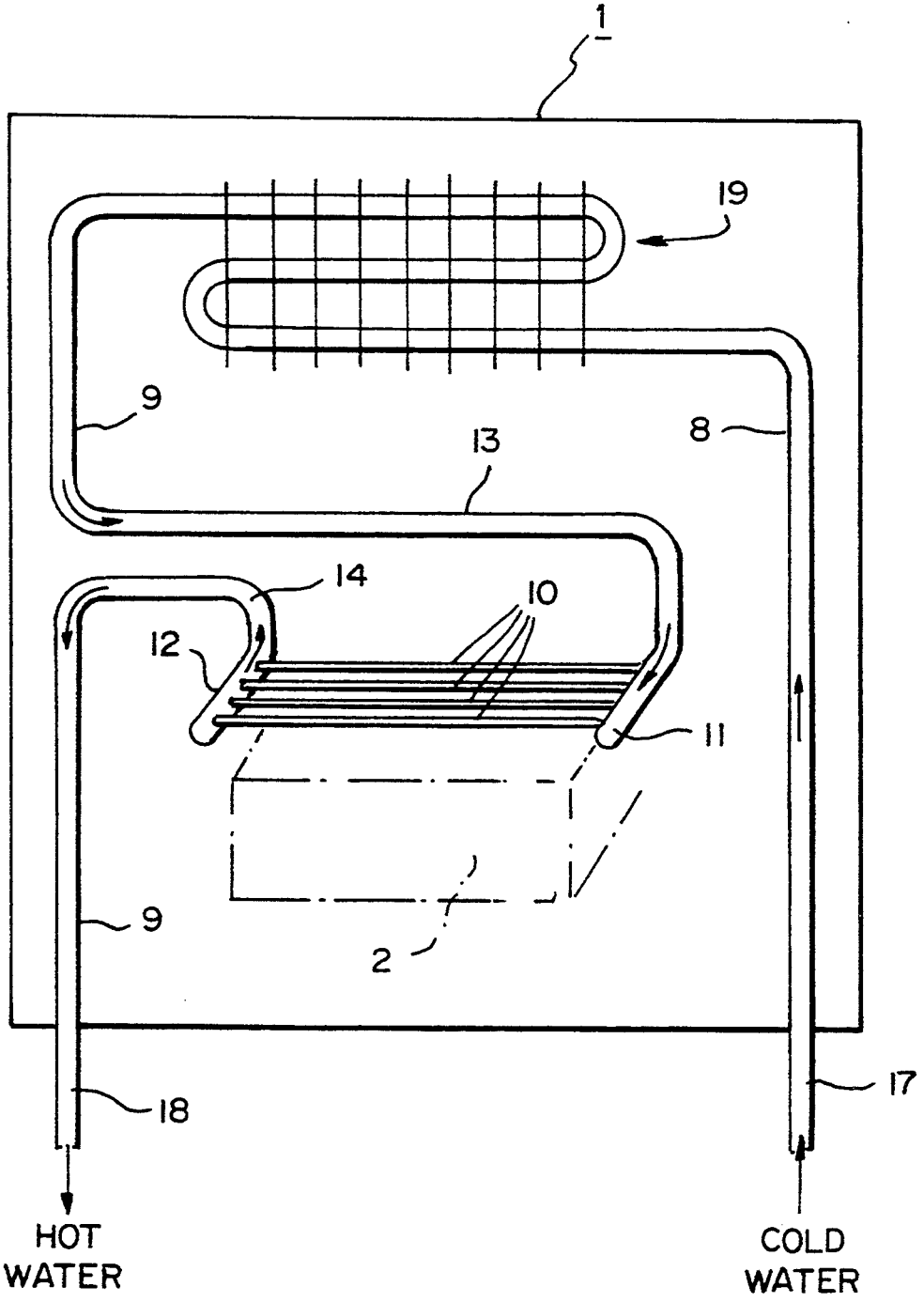
FIG. 5 is a schematic view of another embodiment of a water heater.
Figure 6:
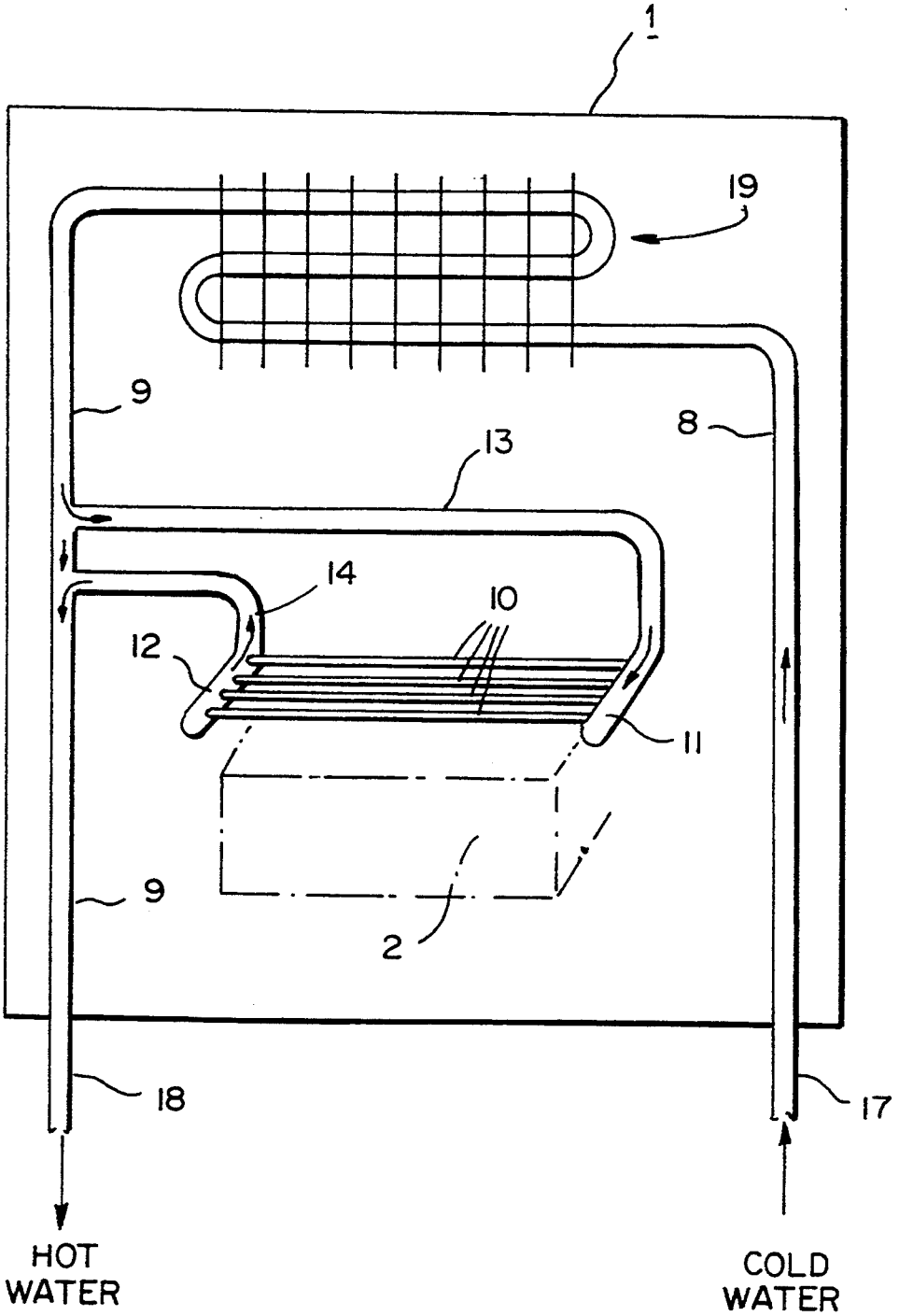
FIG. 6 is a schematic view of another embodiment of a water heater.
Figure 7:
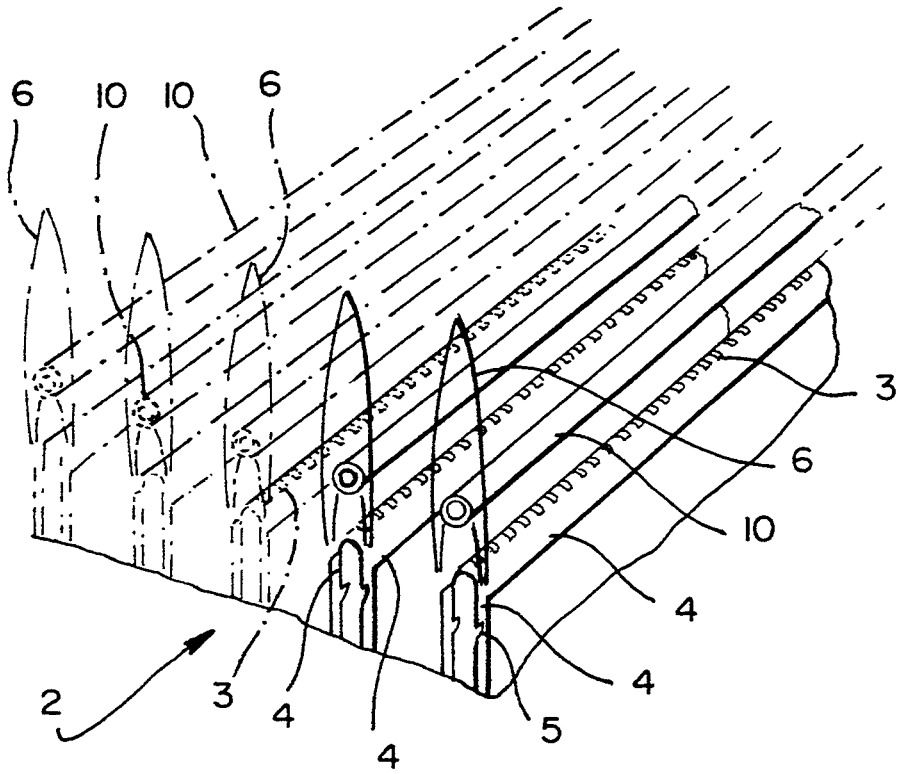
FIG. 7 is a perspective view to illustrate the relationship of the position between a burner having a pilot member and a $NO_x$ reducing water conduit.
Figure 8:
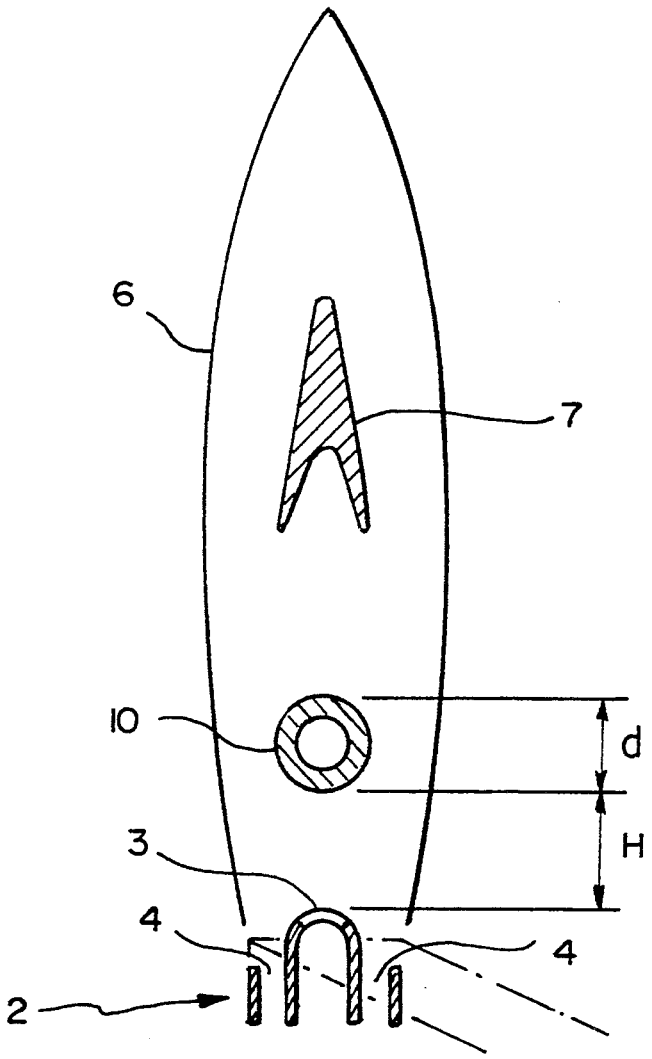
FIG. 8 is a section view of a principal part to illustrate the relationship of the position between a burner having a pilot member and a $NO_x$ reducing water conduit.
Figure 9:
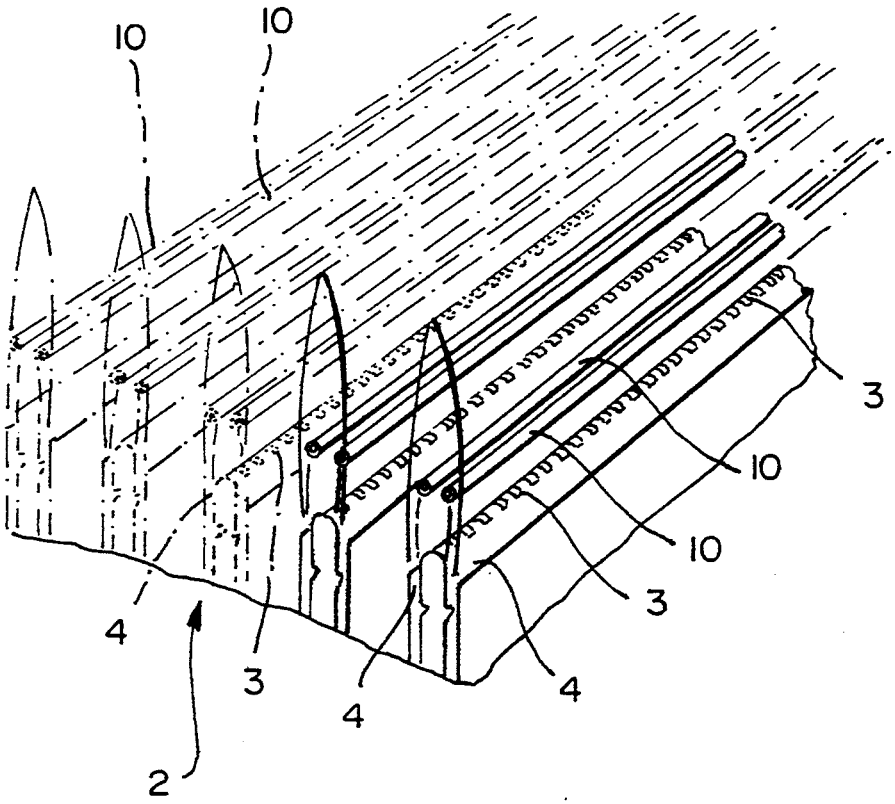
FIG. 9 is a perspective view of another embodiment to illustrate the relationship of the position between a burner having a pilot member and a $NO_x$ reducing water conduit.
Figure 10:
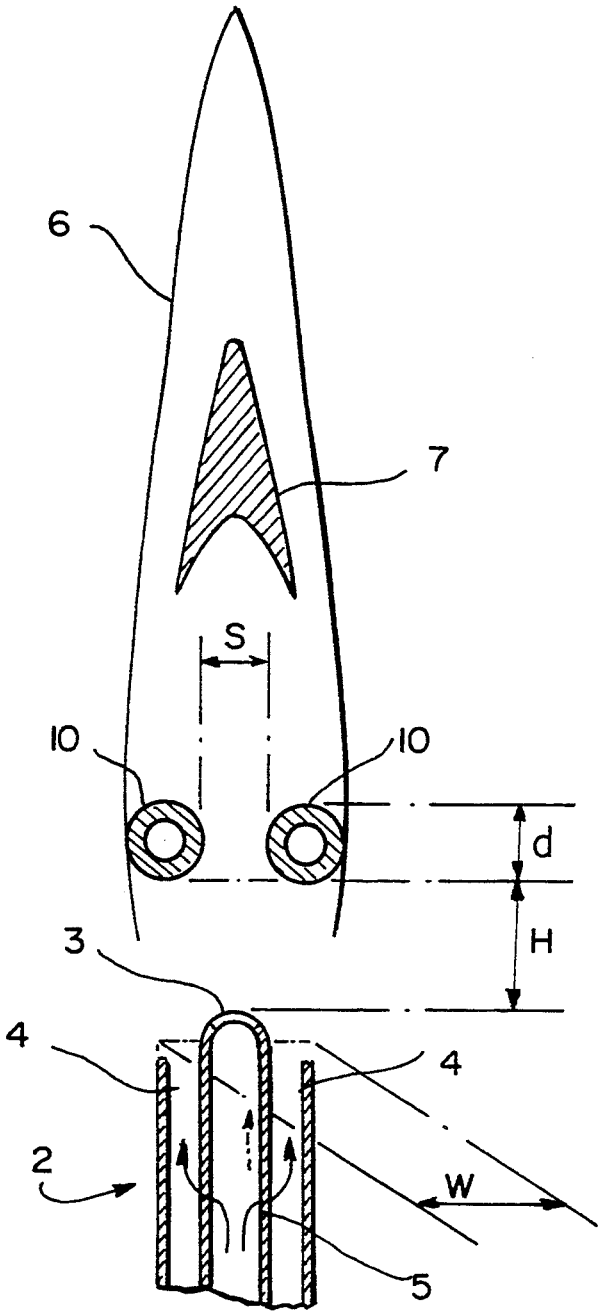
FIG. 10 is a section view of a principal part of another embodiment to illustrate the relationship of the position between a burner having a pilot member and a $NO_x$ reducing water conduit.

Preferably, a water introducing portion 13 is communicated with hot water conduit 9, because the surface temperature of $NO_x$ reducing water conduits 10 becomes higher, so that condensation can be prevented effectively. In FIGS. 5 and 6, both the water introducing portion 13 and water receiving portion 14 are communicated with hot water conduit 9, while in FIGS. 3 and 4, both are communicated with cold water conduit 8. Further, as shown in FIGS. 4 and 6, a part of the cold or hot water may be introduced into $NO_x$ reducing water conduits 10. As shown FIG. 2, water introducing portion 13 may be communicated with cold water conduit 8 and water receiving portion 14 may be communicated with hot water conduit 9.

Figure 19:
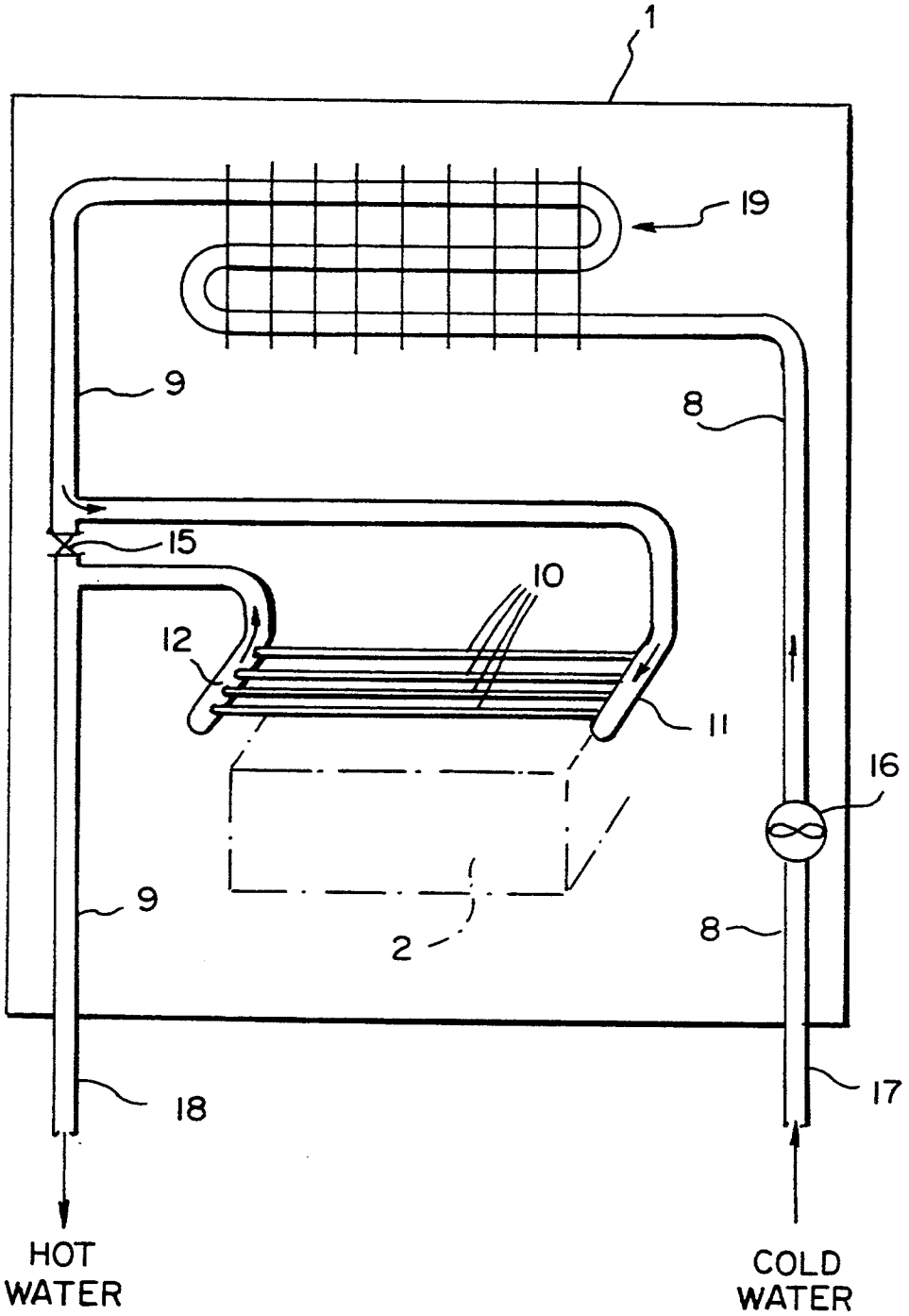
FIG. 19 is a schematic view of another embodiment of a water heater.
Figure 20:
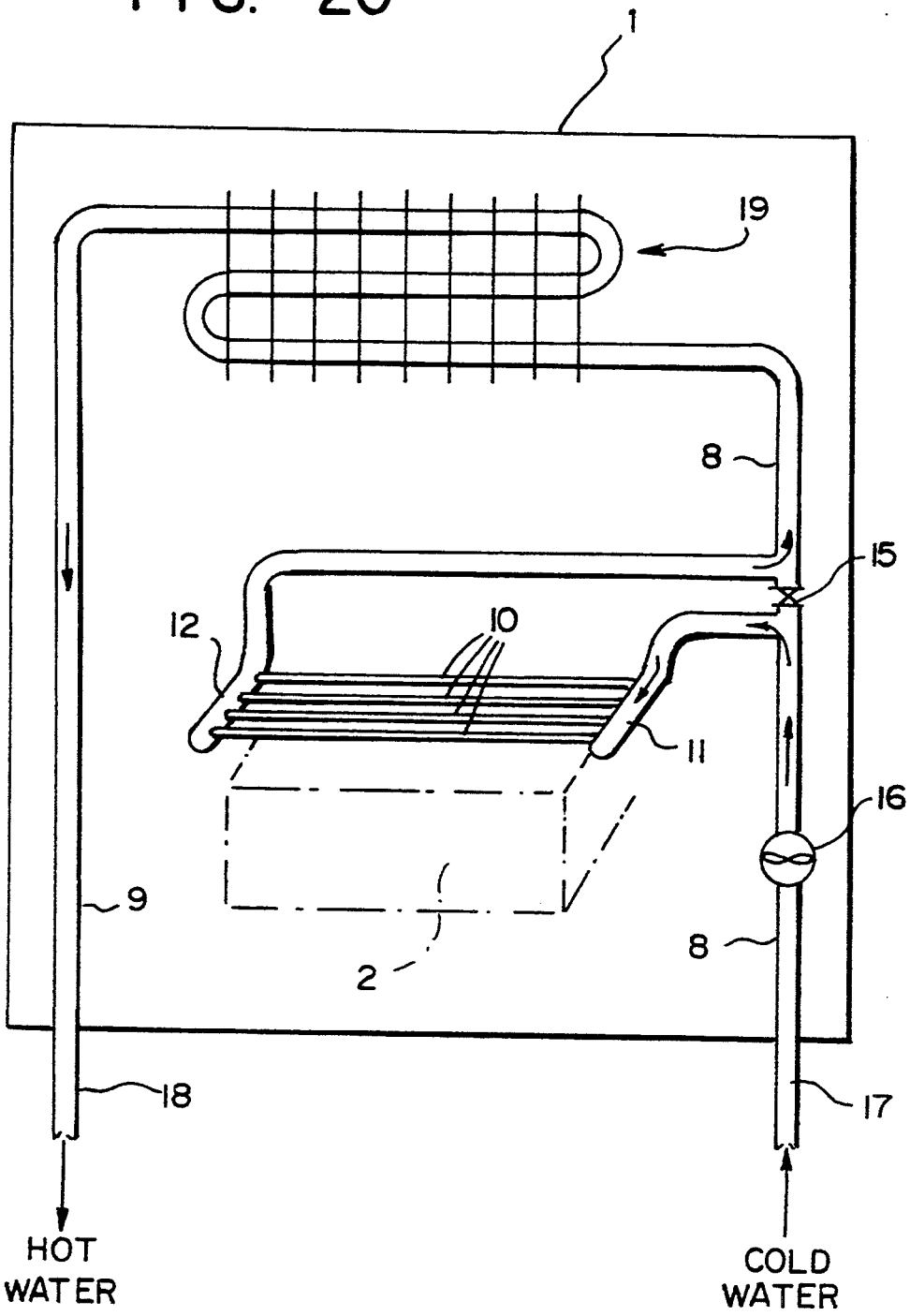
FIG. 20 is a schematic view of another embodiment of a water heater.

Referring to FIGS. 19 and 20, water heater 1 includes a water quantity control valve 15. When the flow rate is large, control valve 15 is opened due to a signal from a water flow sensor 16, while when the former is small, the latter is closed. In this way, by suitably controlling the water flow to be supplied into $NO_x$ reducing water conduits 10, it becomes possible to prevent the decline of the surface temperature of $NO_x$ reducing water conduits 10. Further, control valve 15 prevents water from boiling in $NO_x$ reducing water conduits 10 when the flow rate is small. In addition, when the pressure loss of water flow in $NO_x$ reducing water conduits 10 becomes larger, control valve 15 can make a suitable adjustment so as to maintain a proper rate of water flow in the $NO_x$ reducing water conduits 10.

Referring to FIGS. 7, 9, 13 and 15, the plurality of $NO_x$ reducing water conduits 10 are disposed, in parallel, above a plurality of partially aerated burners 2. These embodiments show the plurality of $NO_x$ reducing water conduits 10 disposed in an appropriate position in flame 6. Since the distance between adjacent $NO_x$ reducing water conduits 10 is small, it is usually difficult to form ta small radius bend, however, the need for such a bend is eliminated since both ends of each $NO_x$ reducing water conduit 10 are connected to water distribution manifold 11 and water collection manifold 12. Therefore, it is easy to manufacture such a system.

As discussed above, the water distribution manifold and water collection manifold which are superposed above the burner in the midst of a flow passage from the cold water inlet to the hot water outlet are communicated with the plurality of $NO_x$ reducing water conduits each of which is smaller than the outer and inner diameter of the cold water conduit as well as the hot water conduit. As a result, the heat of the combustion gas from the burner can be absorbed efficiently by the plurality of $NO_x$ reducing water conduits which are disposed in an appropriate position in flame so as to reduce $NO_x$ output effectively. This advantage is very suitable for a water heater having high combustion load and a large number of partially aerated burners.

The advantages and features of the above described embodiments of the present invention are summarized below.

Since the plurality of $NO_x$ reducing water conduits are connected to both of the water distribution manifold and water collection manifold, the small distance between adjacent $NO_x$ reducing water conduits is not a problem.

The surface temperature of each $NO_x$ reducing water conduit is maintained in such a condition so that the present device can prevent condensation from developing, the associated corrosion of the $NO_x$ reducing water conduits, and bad combustion characteristics or the like.

Additionally, since the outer and inner diameter of each $NO_x$ reducing water conduit is smaller than that of the cold water conduit and of the hot water conduit, it is possible to prevent a combustion noise occurring due to disorder of the combustion gas flow.

Furthermore, since the water flow rate of all the $NO_x$ reducing water conduits is always kept uniform, the present device can prevent condensation from developing as well as a water boiling phenomenon in the $NO_x$ reducing water conduits when the flow rate is low.

Still further, since the water having passed the plurality of $NO_x$ reducing water conduits can be used for the hot water, there is no decrease of thermal efficiency at all.

Since $NO_x$ reducing conduits are heat absorbing water conduits, they will not be damaged by combustion heat and their durability can be largely improved.

The water heater according to the present invention may be used for a hot water supplying device which supplies hot water directly from its hot water outlet for bath water, etc., or as a space heater by using only the heat produced by the circulation of hot water.

What is claimed is:

1. A water heater with reduced nitrogen oxides output, having a partially aerated burner producing a laminar flame using partially premixed combustion constituents above a plurality of serially aligned flame ports, comprising:

a plurality of $NO_x$ reducing water conduits disposed at a downstream side of said partially aerated burner in such a manner that one of cold water or hot water is supplied from one of cold water conduit or hot water conduit of said water heater into said plurality of $NO_x$ reducing water conduits by means of a water introducing portion through one of a branching connection or a serial connection; and said one of said hot water or said cold water being heated by absorbing heat through said plurality of $NO_x$ reducing water conduits and returned to said cold water conduit or said hot water conduit through a water receiving portion.

2. A water heater with reduced nitrogen oxides output as claimed in claim 1 wherein said water introducing portion is formed such that a part of a water flow in said cold water conduit is introduced into said plurality of $NO_x$ reducing water conduits and then fed therefrom into said hot water conduit.

3. A water heater with reduced nitrogen oxides output as claimed in claim 1 wherein said water introducing portion is formed such that all water flowing in said cold water conduit is introduced into said plurality of $NO_x$ reducing water conduits and then fed therefrom to return to said cold water conduit.

4. A water heater with reduced nitrogen oxides output as claimed in claim 1 wherein said water introducing portion is formed such that a part of a water flow in said cold water conduit is introduced into said plurality of $NO_x$ reducing water conduits and then fed therefrom to return to said cold water conduit.

5. A water heater with reduced nitrogen oxides output as claimed in claim 1 wherein said water introducing portion is formed such that all of water flowing in said hot water conduit is introduced into said plurality of $NO_x$ reducing water conduits and then fed therefrom to return to said hot water conduit.

6. A water heater with reduced nitrogen oxides output as claimed in claim 1 wherein said water introducing portion is formed such that a part of a water flow in said hot water conduit is introduced into said plurality of $NO_x$ reducing water conduits and then fed therefrom to return to said hot water conduit.

7. A water heater with reduced nitrogen oxides output as claimed in claim 1 wherein:

said $NO_x$ reducing water conduits are disposed in an appropriate positional range;

a distance "H" is the distance between said $NO_x$ reducing water conduits and the surface of said burner ports;

a distance "W" is the width of a burner port surface:

said appropriate positional range is defined by the formula $$0<H\leqq 5W$$

such that said $NO_x$ reducing water conduits are located between burner ports and an area of the highest flame temperature in said laminar flame formed at the downstream side of said burner ports; and heat is removed from said laminar flame by means of heat absorption by said $NO_x$ reducing water conduits, thereby lowering the temperature of said laminar flame in the said highest flame temperature area at the downstream side of said $NO_x$ reducing conduits.

8. A water heater with reduced nitrogen oxides output as claimed in claim 7 wherein:

said $NO_x$ reducing water conduits have a diameter "d" restricted to the range represented by the formula $$d\leqq W,$$

such that an output of nitrogen oxides is thereby reduced and at the same time an output of carbon monoxide is thereby restricted.

9. A water heater with reduced nitrogen oxides output as claimed in claim 8 wherein said partially aerated burner has burners each provided with a single $NO_x$ reducing water conduit superposed right above the burner port surfaces of said partially aerated burner.

10. A water heater with reduced nitrogen oxides output as claimed in claim 8 wherein:

said partially aerated burner has burners each provided with a pair of $NO_x$ reducing water conduits superposed right above the surface of the ports of said burner so as to be laterally parallel to each other with a space therebetween having the distance "S"; and said distance being in the range represented by the formula $$0<S\leqq W.$$

11. A water heater comprising:

a burner;

a cold water conduit having a cold water inlet;

a hot water conduit having a hot water outlet;

a water distribution manifold disposed at one side above said burner and communicated with a water flow passage from said cold water inlet to said hot water outlet;

said water distribution manifold being communicated to said water flow passage by means of a water introducing portion;

a water collection manifold disposed at the other side above said burner and communicated by means of a water receiving portion to said water flow passage;

a plurality of $NO_x$ reducing water conduits connected between said water distribution manifold and said water collection manifold and disposed above said burner; and an outer and inner diameter of each of said plurality of $NO_x$ reducing water conduits being smaller than that of said cold water conduit and of said hot water conduit.

12. A water heater as claimed in claim 11 wherein a feeding direction in said water collection manifold is contrary to an introducing direction in said water distribution manifold.

13. A water heater as claimed in claim 11 wherein said water introducing portion and said water receiving portion are communicated with said hot water conduit.

14. A water heater as claimed in claim 11 wherein said water introducing portion and said water receiving portion are communicated with said cold water conduit.

15. A water heater as claimed in claim 11 wherein said water introducing portion is communicated with said cold water conduit, while said water receiving portion is communicated with said hot water conduit.

* * * * *